United States Patent [19]

Scholl et al.

[11] Patent Number: 4,787,326

[45] Date of Patent: Nov. 29, 1988

[54] METHOD FOR OPERATING AN AUTOMATIC SEWING DEVICE WITH A SEWING HEAD INCLUDING A ROTARY HOUSING

[76] Inventors: Hans Scholl, Wellbachstrasse 13, D-4811 Oerlinghausen-Lipperreihe; Hans-Jürgen Wessel-Schlickmann, Preussweg 3, D-5100 Aachen, both of Fed. Rep. of Germany

[21] Appl. No.: 92,685

[22] Filed: Sep. 3, 1987

[30] Foreign Application Priority Data

Sep. 20, 1986 [DE] Fed. Rep. of Germany ..... 3632046

[51] Int. Cl.[4] ..... D05B 21/00

[52] U.S. Cl. ..... 112/262.3; 112/121.12; 112/121.14; 112/259

[58] Field of Search ..... 112/262.3, 266.1, 262.1, 112/121.12, 121.14, 121.15, 259, 70, 73, 321

[56] References Cited

U.S. PATENT DOCUMENTS

| | | | |
|---|---|---|---|
| 3,742,878 | 7/1973 | Byrne et al. | 112/121.12 |
| 4,503,788 | 3/1985 | Giannuzzi et al. | 112/121.4 X |
| 4,512,269 | 4/1985 | Bowditch | 112/121.14 |
| 4,574,718 | 3/1986 | Scholl et al. | 112/121.12 |

*Primary Examiner*—Peter Nerbun

*Attorney, Agent, or Firm*—Laff, Whitesel, Conte & Saret

[57] ABSTRACT

A method for operating a sewing automat with a sewing head with a rotary housing provides a compensation signal for a drive motor, in particular for the x- and y-drive motors of the workpiece holder, respectively, in order to correct errors of stitch length resulting from the superposition of the motion of the rotary housing relative to its drive motions. In order to accomplish this, the method provides the detection of the angular position of the rotary housing from one stitch to the next and the generation of a compensation signal depending on this angle difference.

3 Claims, 4 Drawing Sheets

METHOD FOR OPERATING AN AUTOMATIC SEWING DEVICE WITH A SEWING HEAD INCLUDING A ROTARY HOUSING

FIELD OF THE INVENTION

In general this invention relates to a method for operating an automatic sewing device with a sewing head including a rotary housing for generating a stitch contour in a workpiece according to a pre-given program.

In particular this invention relates to a method for operating an automatic sewing device with a sewing head and a device for generating a two-axis-relative movement between the sewing head and the workpiece to be sewn wherein the sewing head is provided with a rotary housing supported at the sewing head and swivelling drivable by an adjusting shaft, said rotary housing having a needle bar with a needle supported in the rotary housing and reciprocatingly drivable via a crank drive driven by a common drive, which in turn is driven by a main drive shaft of the sewing head, a needle jogging gear connected to the crank drive for generating a needle feed movement, and a thread take-up lever drive coupled to the crank drive for the needle bar. A hook bearing is swivelling drivable by the adjusting shaft about a common axis of the needle and the hook bearing respectively equiangularly to the rotary housing. A hook is arranged in the hook bearing and drivable by the main drive shaft. A drive motor for driving the main drive shaft and an adjustable drive for driving the adjusting shaft are provided, too. Furthermore, there is provided a control unit for a programmable control of the drive and adjusting motors, said control unit comprising a computer and a receptacle for a program carrier, in which the coordinates of the contour points are stored for calculating x- and y-coordinates of the points of needle perforation of a seam contour to be sewn in dependence of the chosen stitch length.

BACKGROUND OF THE INVENTION

U.S. Pat. No. 4,574,718 describes such an automatic sewing device, wherein the needle feed movement is always tangentially directed with respect to the seam at the individual position of stitch formation so that no mentionable forces of displacement between the workpiece and the needle occur. With such a known automatic sewing device there exists the problem that at a rotation of the rotary housing and the hook bearing the needle bar, the needle jogging drive, the thread take-up lever mechanism and the hook will be altered in their relative position resulting in stitch length variations. These stitch length variations increase proportionally with the angle of rotation per stitch about which the rotary housing and the hook bearing are swivelled.

SUMMARY OF THE INVENTION

It is a main object of this invention to propose a method for operating an automatic sewing device of the aforementioned type such that at swivel motions of the rotary housing and the hook bearing, the stitch length and thus the resulting appearance of the seam will not be affected avoiding any modifications of the mechanical components of such an automatic sewing device.

It is a further object of the invention to propose a method for the described automatic sewing device, which is simple to be carried out and which does not require additional components.

The method according to the invention provides a detection of the change in rotary position of the rotary head from one stitch to the next and the generation of a compensatory signal in order to compensate the stitch length variations due to the mechanical coupling so that using the basic advantages of the so-called tangential sewing, an optical appearance of the seam contour having identically maintained length of stitches can be achieved.

An especially advantageous method comprises the provision of a stitch length compensating signal for the x- and the y-motors for the workpiece holder, respectively.

Numerous further advantages and features of the invention will become apparent from the following description of the embodiment in connection with the drawings.

DETAILED DESCRIPTION OF THE EMBODIMENT

Figure 1:
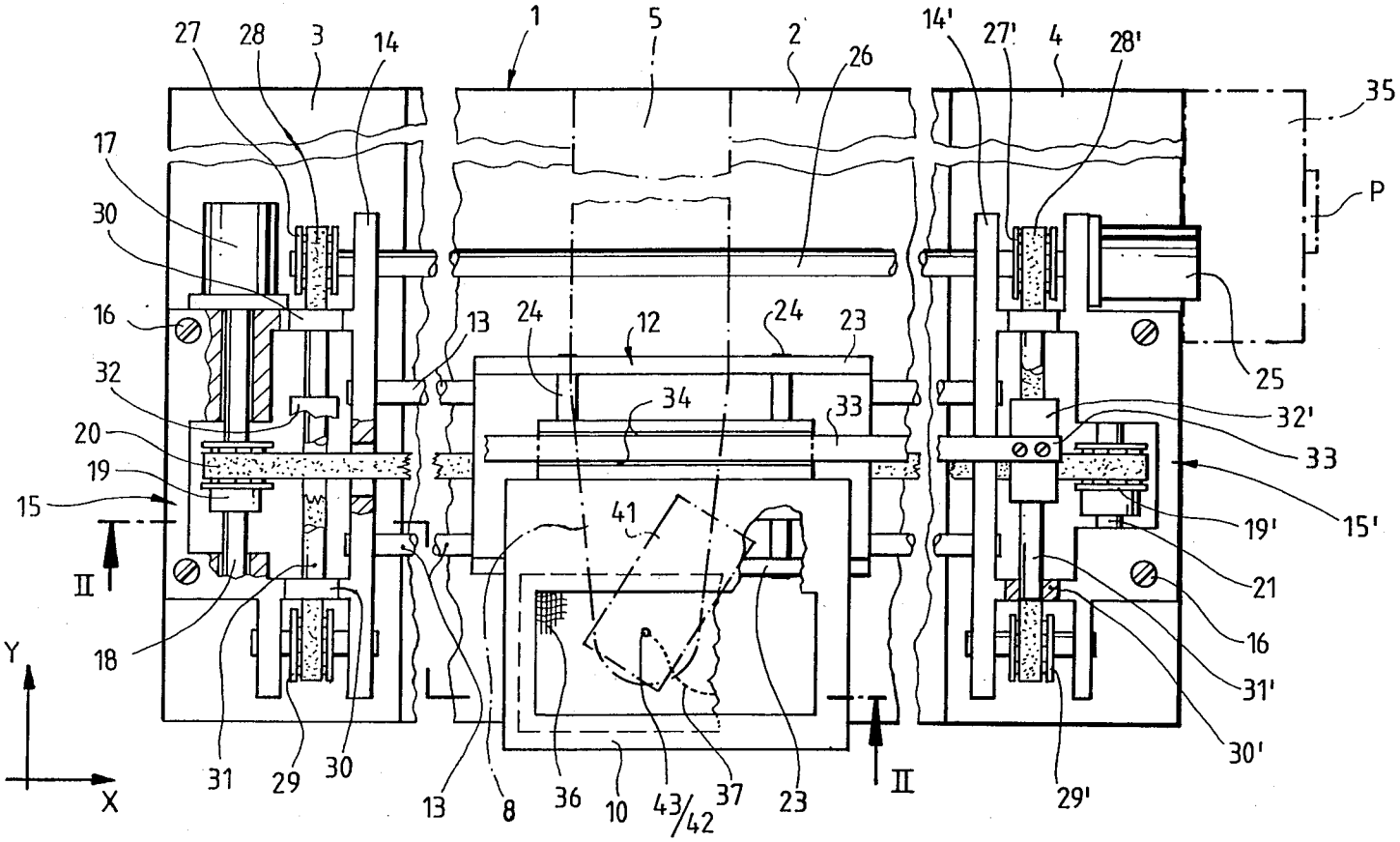
FIG. 1 is a top plan view of an automatic sewing device to be operated according to the invention, in the direction of arrow I in FIG. 2, with the sewing head only being indicated by dot-dash-lines.

Referring to the drawings there is illustrated an automatic sewing device mounted to a stand 1 comprising an intermediate section 2 and two lateral sections 3 and 4. On the intermediate section 2 of the stand 1 there is arranged a sewing head 5, the base plate 6 of which is mounted to the intermediate section 2. The sewing head 5 is formed with a standard 7 extending upwardly from the base plate 6, and an upper arm 8 extending from the standard 7 in parallel with respect to the base plate 6. In the area of the free ends of the base plate 6 and the upper arm 8 there are arranged stitch forming instruments 9. Between the base plate 6 and the upper arm 8, i.e. in the area of the stitch forming instruments 9, there is arranged a workpiece holder 10 movable into two directions of coordinates, i.e. in y-direction corresponding to the main direction of the sewing head 5, and in x-direction extending perpendicularly thereto as obvious from FIG. 2. The workpiece holder 10 is associated to an x-y-carriage-system. This system provides a y-carriage 11 and an x-carriage 12, wherein the workpiece holder 10 is directedly connected to the y-carriage 11. The y-carriage 11 is supported and guided on the x-carriage 12 and displaceable in y-direction relative to the x-carriage 12. The x-carriage 12 is displaceable in x-direction relative to the stand 1. Consequently, the y-carriage 11 together with the workpiece holder 10 is displaceable in x- and y-direction relative to the stand 1.

The x-carriage 12 is displaceably arranged on two guide rods 13, which are stationarily mounted to the stand 1 and which extend parallel to each other. The guide rods 13 are received with each of their ends in bearing webs 14, 14' of bearing blocks 15, 15' mounted to the two lateral sections 3 and 4, respectively, of the stand 1 by means of screws 16.

Figure 2:
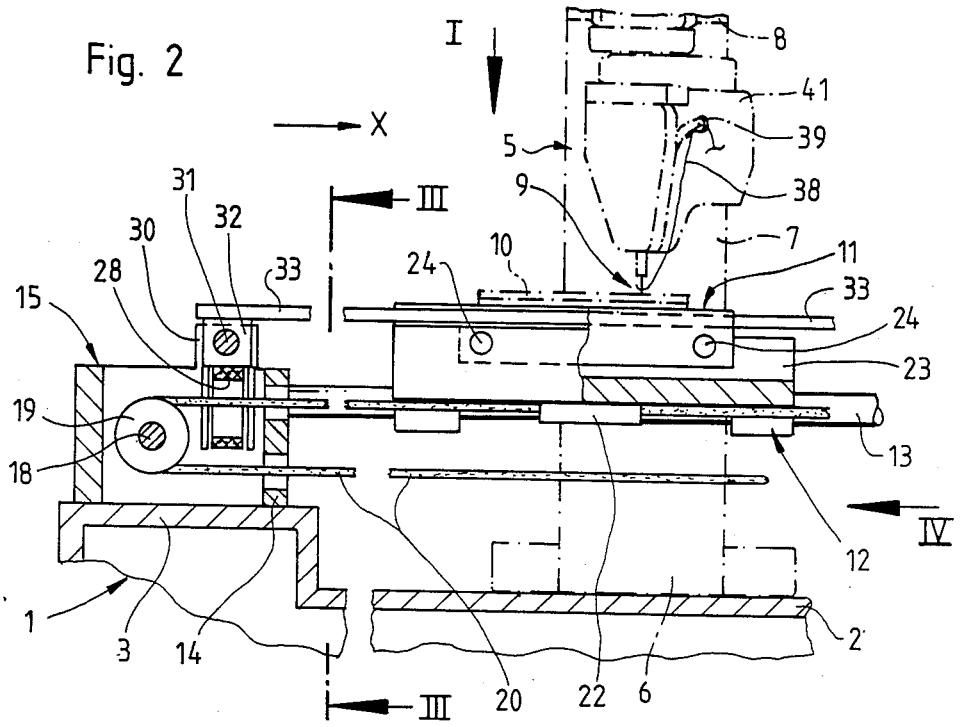
FIG. 2 is a vertical partial section taken along line II—II in FIG. 1.
Figure 3:
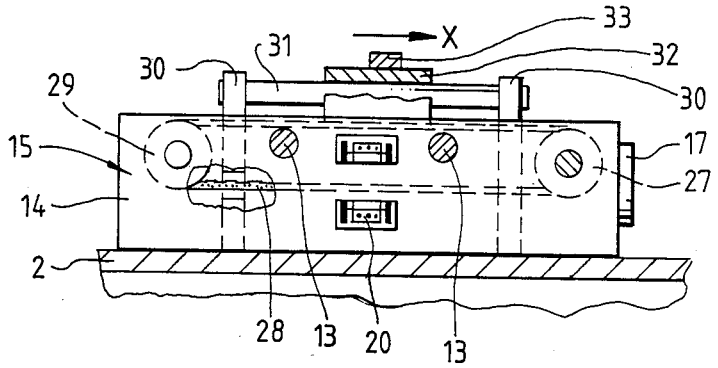
FIG. 3 is a vertical partial cross-section taken along line III—III in FIG. 2.
Figure 4:
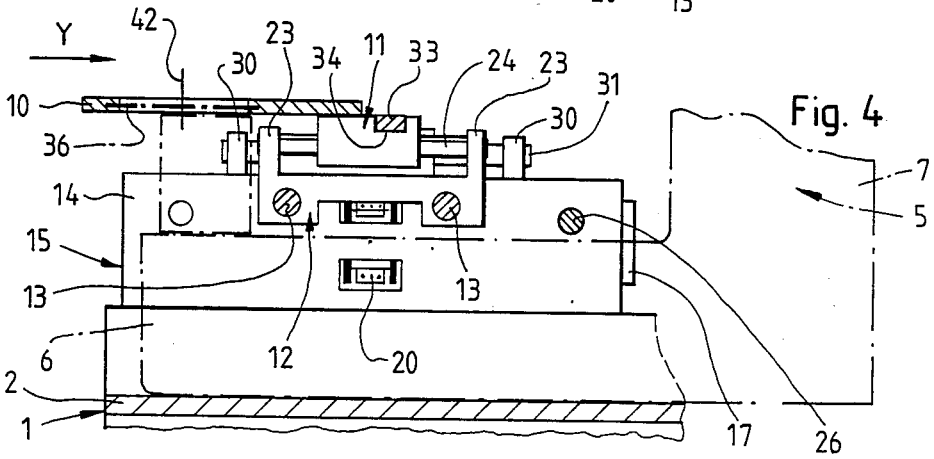
FIG. 4 is a partial side elevation in the direction of the arrow IV in FIG. 2.

To one bearing block 15, which is shown in FIGS. 1 and 2 associated to the left lateral section 3, there is mounted a drive motor 17 for the x-carriage 12. This motor 17 drives a timing belt pulley 19 via a shaft 18, which is supported in the bearing block 15. The timing belt pulley 19 in turn drives an endless timing belt 20 via a timing belt pulley 19'. The timing belt pulley 19' is rotatably supported via an axis 21 in the bearing block 15' located in the right lateral section 4 of the stand 1. The upper strand of the timing belt 20 is secured to the lower surface of the x-carriage 12 by means of a fastening means 22, so that the x-carriage 12 may be displaced on the guide rods 13 in x-direction when correspondingly driven by the drive motor 17. The x-carriage 12 is provided with side walls 23, which extend in x-direction and carry guide rods 24 extending in y-direction. The y-carriage 11 is supported on the guide rods 24 and displaceable in y-direction.

The drive of the y-carriage 11 is accomplished by a drive motor 25. The drive motor 25 is mounted to the bearing block 15' and directly drives a shaft 26 supported in the two bearing blocks 15, 15'. The shaft 26 extends in x-direction. In both bearing blocks 15, 15' timing belt pulleys 27 and 27', respectively, are fixedly mounted to the shaft 26, i.e. the timing belt pulleys 27 and 27', respectively, are rotatingly drivable by the shaft 26. These timing belt pulleys 27 and 27', respectively, each drive an endless timing belt 28 and 28', respectively. Each of the timing belts 28, 28' is guided via timing belt pulleys 29, 29' also supported in the bearing block 15 and 15', respectively. In parallel with and above the timing belts 28, 28' guide rods 31, 31' are mounted in webs 30, 30' of each bearing block 15, 15'. To each of the guide rods 31, 31' there is mounted a slide bearing 32 and 32', respectively, displaceable in y-direction. The two slide bearings 32, 32' arranged oppositely to one another are connected by a guide bar 33 extending in x-direction. Each end of the guide bar 33 is screwed to the corresponding slide bearing 32 or 32', respectively. The guide bar 33 engages a guide groove 34, which is located in the upper surface of the y-carriage 11 and which is matched to the outer circumference of the guide bar 33. The guide groove 34 and the guide bar 33 have no clearance in the y-direction, but they are displaceable to each other in their longitudinal directions, i.e. in x-direction. Due to the drive of the guide bar 33 in y-direction, i.e. transversally with respect to its longitudinal direction, by means of the timing belts 28, 28' engaging the two ends of the guide bar 33 via the slide bearings 32, 32' a canting-free drive of the y-carriage 11 in y-direction is achieved. Movements of the y-carriage 11 together with the x-carriage 12 in x-direction are possible without problems since the guide bar 33 absolutely extends in parallel with the guide rods 13, while a correct drive and a correct guidance in y-direction is achieved due to the fact that the guide rods 31, 31' absolutely extend in parallel with the guide rods 24.

The drive motors 17 and 25 may be designed as step motors or DC-motors with position feed-back, which effect a very precise program-controlled drive of the x-carriage 12, the y-carriage 11 and thus the workpiece holder 10 in x-y-direction.

For the program-controlled drive there is provided a control unit 35 with a receptacle for a program P. In the workpiece holder 10 there is clamped a workpiece 36, in which is produced a seam 37 by means of the stich forming instruments 9 as will be described hereinafter. For producing the seam 37, a needle thread 38 is guided from a spool (not shown) via a thread take-up lever 39 to the stitch forming instruments 9.

Figure 5:
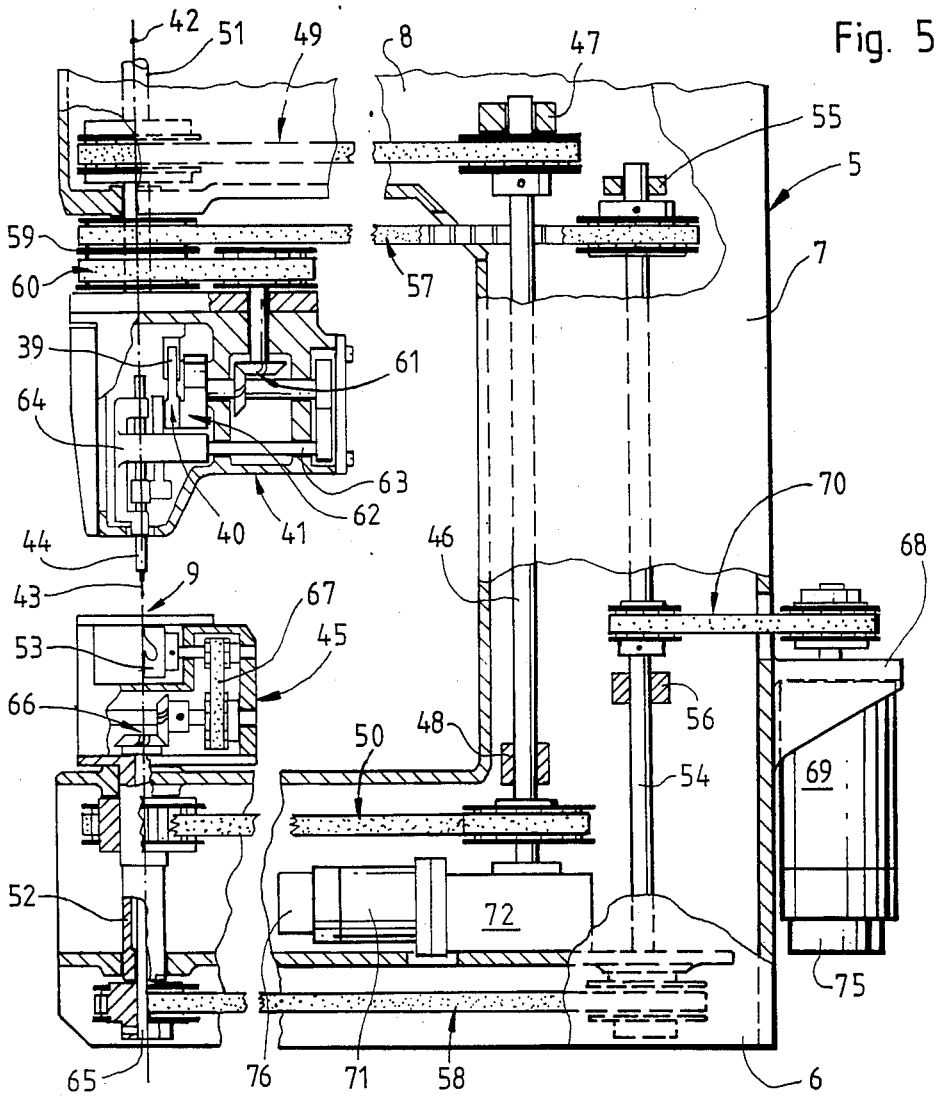
FIG. 5 is a vertical section through the sewing head, with the upper arm partially broken away.
Figure 6:
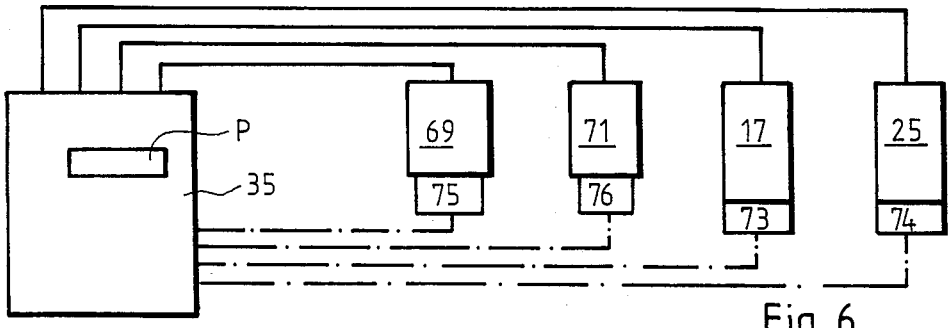
FIG. 6 is a block-diagram-type illustration of the different drive motors with associated pulse generators and the control unit.

The construction of the sewing head 5 substantially is obvious from FIG. 5. At the lower surface of the free end of the upper arm 8 there is supported a rotary housing 41 rotatable about an axis 42. Aligned to this axis 42 there is arranged a needle bar 44 carrying a needle 43. Below the rotary housing 41 and also flushing with the axis 42 there is arranged a hook bearing 45 on the base plate 6 formed as a housing. The hook bearing 45 is equiangularly swivelling or rotating together with the rotary housing 41. The swivel drive of the rotary housing 41 and the hook bearing 45 is effected by an adjusting shaft 46. The adjusting shaft 46 is supported in bearings 47, 47' of the standard 7 and extends in parallel with the axis 42. From both ends of the adjusting shaft 46 timing belt drives 49, 50 are driven. The timing belt drive 49 arranged in the upper arm 8 drives the rotary housing 41 via a shaft 51 concentrically arranged with respect to the axis 42. The lower timing belt drive 50 arranged in the base plate 6 drives the hook bearing 45 via a hollow shaft 52. As the two timing belt drives 49, 50 have an identical transmitting ratio, both, the rotary housing 41 and the hook bearing 45, are equiangularly driven.

The needle bar 44 together with the needle 43 on one hand and the hook 53 in the hook bearing 45 on the other hand are driven by a common drive shaft 54 serving as a main drive shaft. The shaft 54 is supported in the standard 7 by means of bearings 55, 56 and extends in parallel with the adjusting shaft 46. The shaft 54 drives the needle bar 44 and the hook 53 via timing belt drives 57, 58 each located in the area of the ends of the drive shaft 54. The upper timing belt drive 57 associated to the upper arm 8 terminates in a double timing belt pulley 59 arranged concentrically with respect to the shaft 51 and thus with the axis 42. This pulley 59 is not connected to the shaft 51. The double timing belt pulley 59 drives via a further timing belt drive 60 located on the upper surface of the rotary housing 41, a bevel gear drive 61 situated in the rotary housing 41. The bevel gear drive 61 in turn drives a crank drive 62, which imparts oscillatory motions to the needle bar 44. Furthermore, the bevel gear drive 61 drives via a rocking shaft 63 a needle bar jogging frame 64, which imparts vibratory motions—so-called needle feed movements—to the needle bar 44. Moreover, the crank drive 62 also drives a thread take-up lever drive mechanism 40 for driving the thread take-up lever 39.

The lower timing belt drive 58 arranged in the base plate 6 drives a hook drive shaft 56 located in the hollow shaft 52. The hook drive shaft 65 drives the hook 53 via a bevel gear drive 66 provided in the hook bearing 45, and a further timing belt drive 67. The design and the drive of the rotary housing 41 inclusive the needle bar 44 supported therein, of the needle bar jogging frame 64 and of the thread take-up lever drive mechanism 40 as well as the design and the drive of the hook bearing 45 inclusive the drive of the hook 53 located in the latter by the adjusting shaft 46 and the drive shaft 54, respectively, are known from U.S. Pat. No. 4,574,718, reference to which is expressively made in order to avoid repetitions.

The drive of the drive shaft 54 is accomplished by a drive motor 69 mounted to a flange 68 at the standard 7 via a timing belt drive 70. The drive of the adjusting shaft 46 is accomplished by a servo motor 71 including a gear 72, both situated in a housing formed by the base plate 6. Each of the motors is provided with rotary position detectors 73, 74, 75, 76, which put out a pre-given number of pulses at one revolution of the individual motor shaft, so that the angular position of the individual motors is detectable.

At a swivel motion of the rotary housing 41 the needle bar 44, the thread take-up lever drive mechanism 40 and the needle bar jogging frame 64 carry out a movement due to the roll-off-movement of the timing belt drive 60 on the double timing belt pulley 59. Equally, the hook 53 is rotated due to the roll-off-movement within the bevel gear drive 66. Thus, a change of the position of the needle 43 and the hook 53 results, which causes a change of the stitch length at running machine without compensating influence, which stitch length increases as increases the rotary angle of the rotary housing 41 and the hook bearing 45 per stitch.

Figure 7:
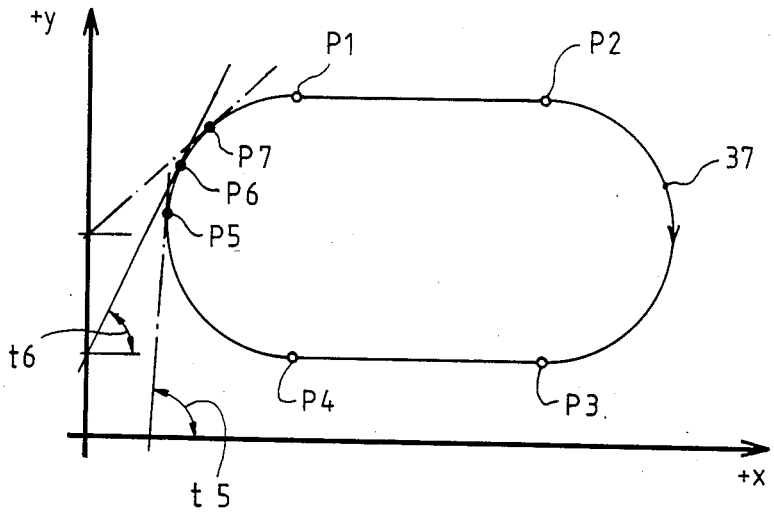
FIG. 7 is a schematic illustration of a seam contour in x-y-plane.

In FIG. 7 a seam contour is illustrated, which requires a swivel motion of the rotary housng, which leads to a change in the stitch length due to the predescribed conditions.

For purposes of simplification, such a seam contour is illustrated in FIG. 7, which can be essentially characterized by four contour points P1, P2, P3 and P4. The contour points P1 and P2, and P3 and P4, respectively, are each connected by straights, while the contour points P3 and P3, and P4 and P1, respectively, are connected by arc-sections. By storing these contour points in the control unit 35, this control unit is able to calculate the coordinates of the individual stitching points in a known manner according to a usual method of interpolation in dependence on the stored coordinates of the contour points in the x-y-plane and a pre-selectable given in stitch length. The control impulses directly result from the stitching points and are given to the motors 17 and 25 for the drive in x- and y-direction, respectively, at each stitch.

The direction of stitching, i.e. the direction of the seam extension, respectively the direction of a tangent to the seam 37 with respect to a defined reference line, e.g. a reference line in parallel to the x-direction, is also given by the coordinates $x_n$, $y_n$ of an individual stitching point in the x-y-plane.

Correspondingly, this seam direction can be calculated for each stitch point. Since the rotary housing 41 will be correspondingly rotated in order to achieve tangential sewing, e.g. a needle jogging motion in the direction of the extension of the seam, the direction of the tangent to the seam 37 corresponds to the rotary angle t of the rotary housing 41 with respect to the basic line parallel to the x-direction. Subsequently, following stitches, e.g. stitches between the stitching point P5 and P6, and P6 and P7, respectively, are associated to different rotary angles $t_n$, in the present case $t_5$ and $t_6$, as long as no straight contour portion is being sewn.

Figure 8:
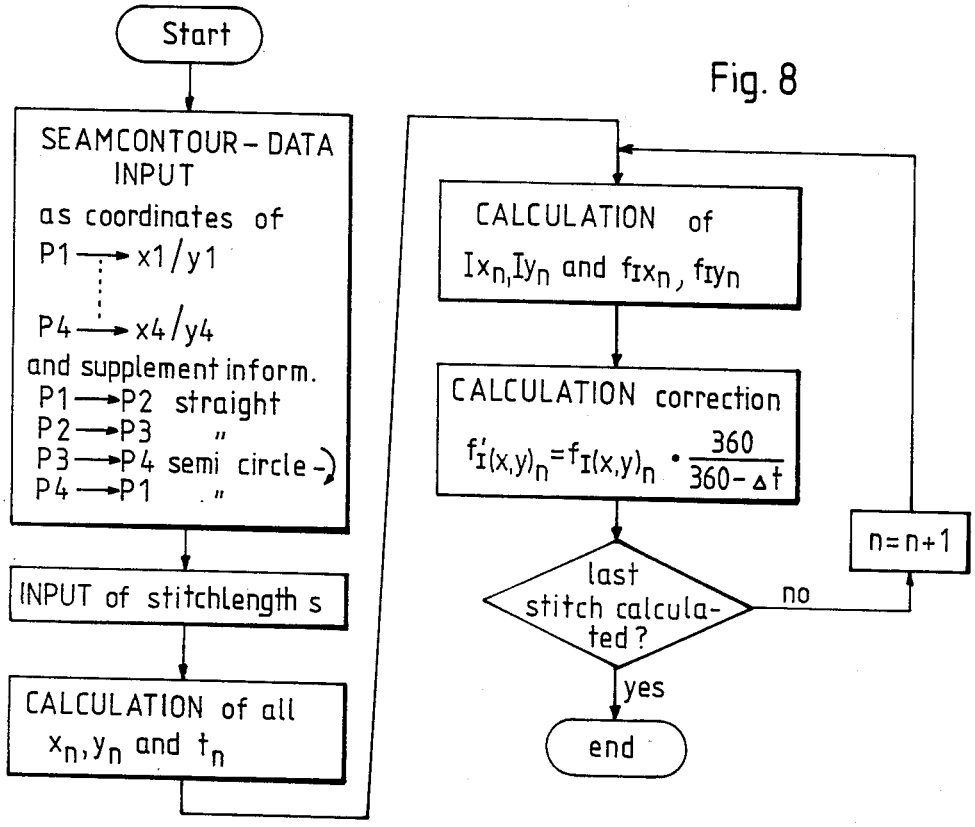
FIG. 8 is a flow chart illustrating the method according to the invention.

The invention is based on the experience that a change in stitch-length due to the rotation of the rotary housing 41 is proportional to the change $\Delta t = t_{n-1} - t$. According to this experience this change is used for the generation of a compensating signal by which, according to this embodiment, the drive of the workpiece holder 10 in x-direction and y-direction, respectively, is corrected, as is illustrated in connection with the flow chart of FIG. 8 referring to a seam contour according to FIG. 7.

Prior to the start of a sewing operation, information of the sewing contour in form of x- and y-coordinates, respectively, of support points will be fed into the control unit 35. If, similar to the support points P1 to P4 in the present embodiment, these support points are connected by simple geometric figures, these, too, can be fed in directly. In another case it is required to feed in a plurality of contour points so as to render possible a mathematical interpolation.

Moreover, a characteristic constant for the length of stitches will be fed in for the seam contour.

On the basis of the input data the computer of the control unit 35 calculates the coordinates $x_n$, $y_n$ and the direction of the seam and the rotary angle $t_n$ of the rotary housing 41, respectively.

The number of control pulses related to the rotary motion of the drive shaft 54 of the sewing head 5 for the drive motors 17 and 25 driving the workpiece holder 10 is modified depending on the change of rotary angle $\Delta t$.

When the rotary housing 41 is not rotated ($\Delta t = 0$), one stitch corresponds to one revolution $U_A$ of the drive shaft 54. The rotary angle $\Delta t$ of this axis is 360°.

The number of pulses I to be put out for the motors 17, 25 of the x- and y-axis corresponds to the quotient derived from the distance portions (in millimeters) for each individual axis at the pre-given stitch length and the resolution A (in millimeters per pulse) of the motor. For a single stitch without tangential motion results:

$$I_{(x,y)n} = \frac{s\,(x,y)_n}{A}$$

The corresponding output frequencies per axis result in proportion to the rotary frequency $f_{UA}$ of the drive shaft 54 as $$f_{I(x,y)} = I_{(x,y)n} \cdot f_{UA}$$

In order to avoid errors of stitch length at a change of the rotary angle $t = 0$) this number of control pulses to be put out per second must be corrected as follows:

$$f'_{I(x,y)n} = \frac{s\,(x,y)_n}{A} \cdot f_{UA} \cdot \frac{360}{360 - \Delta t}$$

Thus, it is achieved that the distance s per axis and stitch will be obtained also with tangential operation mode, so that no errors of stitch length and deviations of contour will occur.

This means that by affecting the workpiece transport there is a steady compensation of the errors of stitch length which are due to the superposition of the rotary motion of the rotary housing 41 with the drive of the needle bar 44, the thread take-up mechanism 40 and the needle bar jogging frame 64, this compensation being achieved by maintaining the pre-given coordinates of the stitch points of the individual stitches and modifying the speed with which each stitch is carried out.

What is claimed is:

1. Method for operating an automatic sewing device with a sewing head and a device for generating a two-axis-relative movement between the sewing head and the workpiece to be sewn wherein the sewing head is provided with a rotary housing supported at the sewing head and swivelling drivable by an adjusting shaft, said rotary housing having a needle bar with a needle supported in the rotary housing and reciprocatingly drivable via a crank drive driven by a common drive, which in turn is driven by a main drive shaft of the sewing head, a workpiece holder that retains the workpiece, whereby said workpiece holder and said sewing head are driven in two directions relative to each other by an x-drive motor and a y-drive motor a needle jogging gear connected to the crank drive for generating a needle feed movement, and a thread take-up lever drive coupled to the crank drive for the needle bar, wherein a hook bearing is provided, which is swivelling drivable by the adjusting shaft about a common axis of the needle and the hook bearing respectively equiangularly to the rotary housing, wherein a hook is arranged in the hook bearing and drivable by the main drive shaft, wherein a drive motor is provided for driving the main drive shaft and an adjustable drive is provided for driving the adjusting shaft, and wherein a control unit is provided for the programmable control of the drive motor and the adjusting motor, respectively, which control unit comprises a computer and a receptacle for a program storing the coordinates of contour points for the computation of the x- and y-coordinates of the stitch points of a seam to be sewn depending on the stitch length chosen, comprising detecting for each stitch point in addition to the x-y-coordinates also the direction of the seam referred to a defined reference line and thus the angle of rotation (t) of the rotary housing, computing the resulting change of the angle of rotation (t) from one stitch point to the next, generating a stitch length correction signal from said computed angle of rotation relative to the rotary movement of the main drive shaft of the sewing head, and feeding said correction signal to the control unit to influence the drive movement of at least one of the x and y drive motors.

2. Method according to claim 1, comprising influencing the drive movement of the x-drive motor and y-drive motor of the workpiece holder, respectively, by the stitch length correction signal.

3. Method according to claim 2, wherein the x-drive-motor and the y-drive-motor, respectively, are step motors controlled by a number of pulses comprising altering the number of control pulses for each motor for a certain stitch to be performed by said correction signal which is formed depending on the angle of rotation (t) detected at the foregoing stitch.

* * * * *